US006152702A

United States Patent [19]

Codina et al.

[11] Patent Number: 6,152,702

[45] Date of Patent: Nov. 28, 2000

[54] CAPACITIVE SENSING APPARATUS FOR SENSING A PLURALITY OF OPERATING PARAMETERS ASSOCIATED WITH A VARIABLE DISPLACEMENT PISTON PUMP

[75] Inventors: George Codina, North Hollywood, Calif.; Donna J. Murr, Dunlap, Ill.

[73] Assignee: Caterpillar Inc., Peoria, Ill.

[21] Appl. No.: 09/275,300

[22] Filed: Mar. 24, 1999

Related U.S. Application Data

[63] Continuation-in-part of application No. 08/760,541, Dec. 5, 1996, abandoned.

[51] Int. Cl.[7] ..... F04B 49/00

[52] U.S. Cl. ..... 417/63; 417/53; 73/118.1; 73/116

[58] Field of Search ..... 417/53, 63; 73/168, 73/118.1, 116

[56] References Cited

U.S. PATENT DOCUMENTS

Re. 31,062 10/1982 Burke, Jr. ..... 335/229

4,473,338 9/1984 Garmong ..... 417/12

4,489,551 12/1984 Watanabe et al. ..... 73/168

5,528,928 6/1996 Baker et al. ..... 73/116

*Primary Examiner*—Timothy S. Thorpe

*Assistant Examiner*—Timothy P. Solak

*Attorney, Agent, or Firm*—Steve D. Lundquist; James R. Yee

[57] ABSTRACT

An apparatus and method for sensing a parameter of a hydraulic pump. The hydraulic pump includes a housing and an input shaft. The shaft is rotationally driven relative to the housing and electrically coupled to the housing. The hydraulic pump forms a variable capacitor. The apparatus includes an electrode portion positioned adjacent to the input shaft and is electrically isolated from the housing and input shaft. The electrode portion and the input shaft form a fixed capacitor. The fixed capacitor and the variable capacitor are coupled. The apparatus supplies electrical energy to the electrode portion and produces a capacitive signal indicative of the capacitance value of the variable capacitor. The apparatus further applies a filter to the capacitive signal and produces a filtered capacitive signal. The parameter of the hydraulic pump is determined as a function of the filtered capacitive signal.

31 Claims, 8 Drawing Sheets

CAPACITIVE SENSING APPARATUS FOR SENSING A PLURALITY OF OPERATING PARAMETERS ASSOCIATED WITH A VARIABLE DISPLACEMENT PISTON PUMP

This application is a continuation-in-part of application Ser. No. 08/760,541 filed Dec. 5, 1996 now abandoned.

TECHNICAL FIELD

This invention relates generally to an apparatus and method for sensing a plurality of operating parameters associated with a hydraulic pump and, more particularly, to a capacitive sensing apparatus and method for sensing a plurality of parameters of a hydraulic piston pump.

BACKGROUND ART

As the electronic age continues to transform technology, it has become prevalent to use electronic sensing devices to monitor the operating parameters of machinery.

For example, it is desirable to sense the pump displacement, revolutions per minute, pressure, as well as other parameters and/or fault indications of a hydraulic pump. A sensor to measure each parameter could be included.

However, as the number of measurable operating parameters increase, the number of sensors required to measure the operating parameters increases proportionally. Unfortunately the increased number of sensors increases electronic packaging requirements, increases pump cost, and decreases electronic circuit reliability.

The present invention is directed at overcoming one or more of the problems as set forth above.

DISCLOSURE OF THE INVENTION

In one aspect of the present invention, an apparatus for sensing a parameter of a hydraulic pump is provided. The hydraulic pump includes a housing and an input shaft. The shaft is rotationally driven relative to the housing and electrically coupled to the housing. The apparatus includes an electrode portion positioned adjacent to the input shaft and electrically isolated from the housing and input shaft. The hydraulic pump forms a variable capacitor and the electrode and the input shaft form a fixed capacitor. The apparatus supplies electrical energy to the electrode portion and produces a capacitive signal indicative of the capacitance value of the variable capacitor. The apparatus further applies a filter to the capacitive signal and produces a filtered capacitive signal. The parameter of the hydraulic pump is determined as a function of the filtered capacitive signal.

In another aspect of the present invention a method for sensing a parameter of a hydraulic pump is provided. The hydraulic pump includes a housing, an input shaft, and an electrode portion. The input shaft is rotationally driven relative to the housing and is electrically coupled to the housing. The electrode portion is positioned adjacent to the input shaft and is electrically isolated from the housing and input shaft. The hydraulic pump forms a variable capacitor and the electrode portion and the input shaft form a fixed capacitor. The method includes the steps of supplying electrical energy to the electrode portion and responsively producing a capacitive signal indicative of the capacitance value of the variable capacitor; receiving the capacitive signal, applying a filter to the capacitive signal and responsively producing a filtered capacitive signal; and, determining the parameter of the hydraulic pump as a function of the filtered capacitive signal.

BEST MODE FOR CARRYING OUT THE INVENTION

Figure 1:
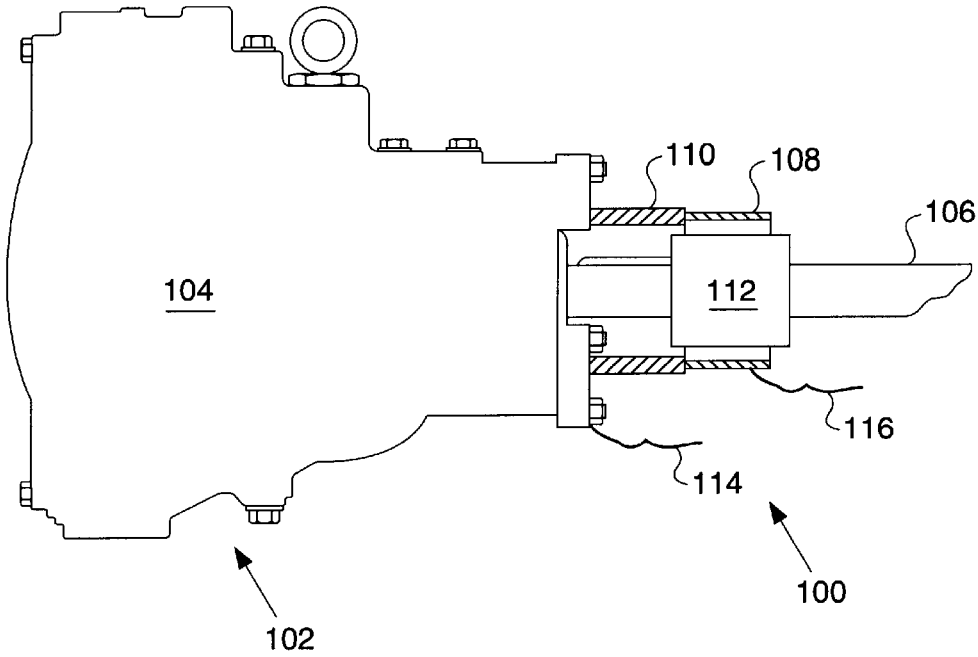
FIG. 1 is a diagrammatic illustration of a hydraulic piston pump and a portion of an apparatus for determining a plurality of parameters of the hydraulic piston pump.
Figure 2:
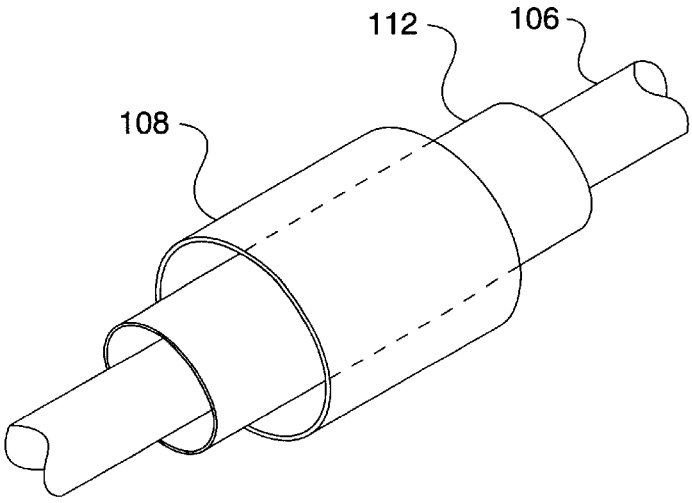
FIG. 2 is a diagrammatic illustration of another view of the apparatus of FIG. 1.

With reference to FIGS. 1–2, the present invention provides an apparatus 100 for sensing at least one parameter of a hydraulic pump 102. In addition, the apparatus 100 may be configured to display the parameters in either digital or analog format. The hydraulic pump 102 includes a housing 104 and an input shaft 106. The shaft 106 is rotationally driven relative to the housing 104 and the pump 102 provides pressurized fluid flow in response. The shaft 106 is electrically coupled to the housing 104, i.e., the shaft is coupled to the housing such that electrical current is allowed to flow between them.

The apparatus 100 includes an electrode portion 108 positioned adjacent to the input shaft 106. The electrode portion 108 is electrically isolated from the housing 104 and input shaft 106 via an electrode insulating portion 110. The electrode insulating portion 110 may be constructed from nylon, kevlar, lexan or any suitable rigid insulating material.

As best shown in FIG. 2 in the preferred embodiment, the electrode portion 108 is tube-shaped and surrounds the input shaft 106. An input shaft extender 112 may be required to achieve the proper spatial relationship between the input shaft 106 and the electrode portion 108. The input shaft extender 112 is constructed of metal, preferably aluminum. The electrode portion 108 and the input shaft 106 form a fixed pick-up capacitor. The hydraulic pump 102 forms a variable capacitor serially connected to the fixed capacitor. The variable internal capacitance of the pump 102 is indicative of the parameter being sensed.

Figure 3:
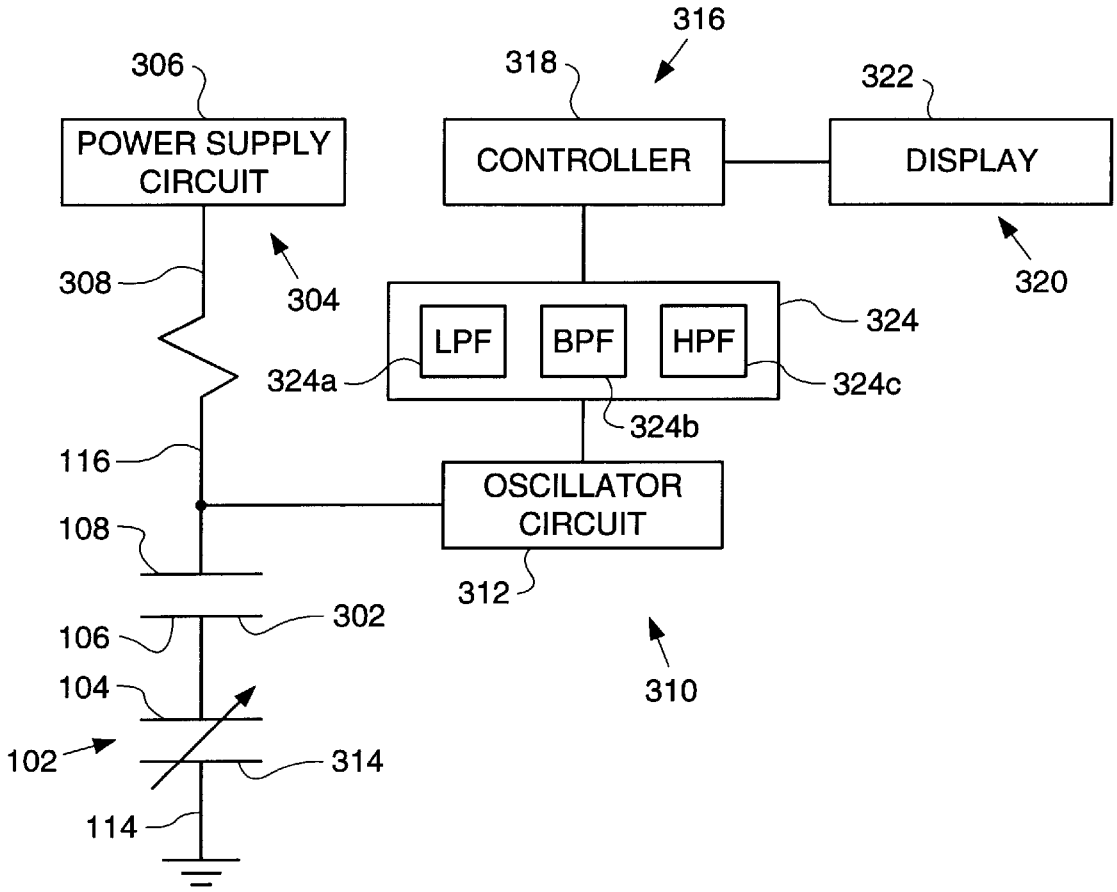
FIG. 3 is a block diagram of the apparatus of FIG. 1.

With reference to FIG. 3, the apparatus 100 includes a power supplying means 304 for supplying electrical energy to the electrode portion 108, by way of electrical connections 114,116, and energizing the fixed capacitor 302 formed by the electrode portion 108 and the input shaft 106.

In the preferred embodiment, the power supplying means 304 includes a power supply circuit 306 and a current limiting resistor 308.

An oscillator means 310 produces a capacitive dependent signal indicative of the capacitance value of the variable internal capacitance of the pump 102 (represented by the variable capacitor 314). As shown, the variable capacitor 314 is connected between the fixed capacitor 302 and electrical ground.

In the preferred embodiment, the oscillator means 310 includes an oscillator circuit 312. Power supply and oscillator circuits of this type are well known in the art and therefore not further discussed.

A controlling means 316 receives the capacitive signal. In the preferred embodiment, the controlling means 316 includes a microprocessor based controller 318. A filter 324 is applied to the capacitive signal, responsively producing a filtered capacitive signal. The filter 324 utilized is dependent upon the parameter being determined. For example, the filter 324 may be a low pass filter (LPF) 324*a*, a band pass filter (BPF) 324*b*, a high pass filter (HPF) 324*c*, or any combination of the above filters 324. Preferably, the filter 324 is an analog filter of a type known in the art and suited for filtering the capacitive signal. However, the filter 324 may be digital, e.g., generated and controlled by the controlling means 316. The present invention may include an analog to digital or a digital to analog converter (not shown) as needed to provide compatibility for the filter 324.

A display means 320 displays information relating to the sensed parameter(s) to an operator. In the preferred embodiment, the display means 320 includes a display 322 which may signal the operator as to a fault condition or indicate to the operator, in analog or digital form, the magnitude of any sensed parameter.

Figure 12:
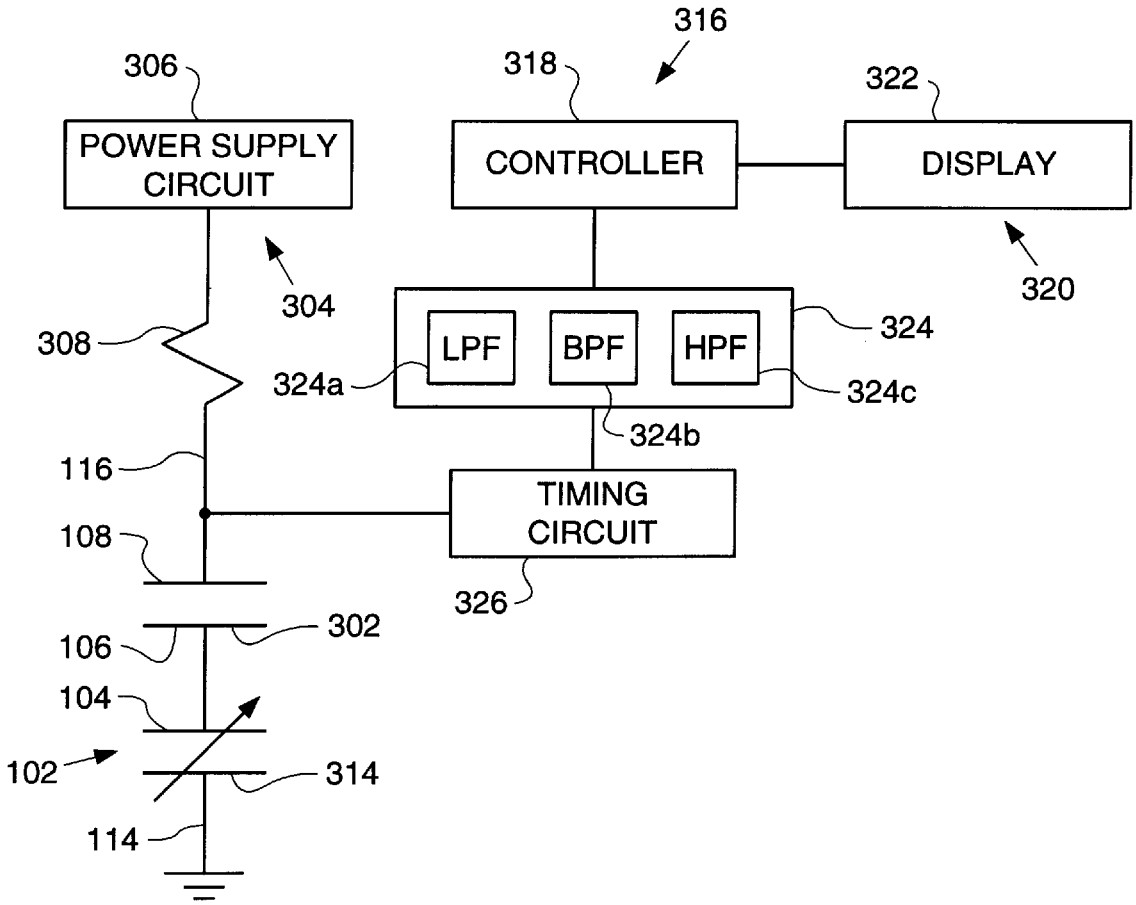
FIG. 12 is a block diagram of an alternative embodiment of the apparatus of FIG. 1.

In an alternative embodiment, reference is made to FIG. 12, in which the oscillator circuit 312 is replaced with a timing circuit 326, e.g., an RC timing circuit using, for example, a 555 timer chip, as is well known in the art. Preferably, the current limiting resistor 308 functions as a time constant resistor in conjunction with the capacitors 302,314.

The output of the timing circuit 326 is a series of variable width pulses, which are filtered and processed as discussed throughout this specification. The frequency corresponds to the value of the variable capacitance 314 of the pump 102.

In a first embodiment, the controller 318 determines a parameter of the hydraulic pump 102 as a function of the filtered capacitive signal. In the preferred embodiment, the determined parameter is either pump displacement, pump speed (rotational speed of the input shaft), or pump output pressure. Table 1 shows these parameters and the corresponding filter type. The parameters of the filters 324 are dependent upon the characteristics of the hydraulic pump 102.

TABLE 1

Determined Parameter and Filter Type.

| Determined Parameter | Filter Type |
|---|---|
| pump displacement | low pass |
| pump speed | low pass |
| pump output pressure | band pass |
| pump fault condition | high pass |

In a second embodiment, the apparatus 100 senses first and second parameters of the hydraulic pump 102. The controller 318 applies respective first and second filters 324 to the capacitive signal and responsively determines each parameter.

In a third embodiment, the apparatus 100 senses pump displacement, pump speed, and pump output pressure. The controller applies a respective filter 324 to the capacitive signal and responsively determines each parameter.

Figure 4:
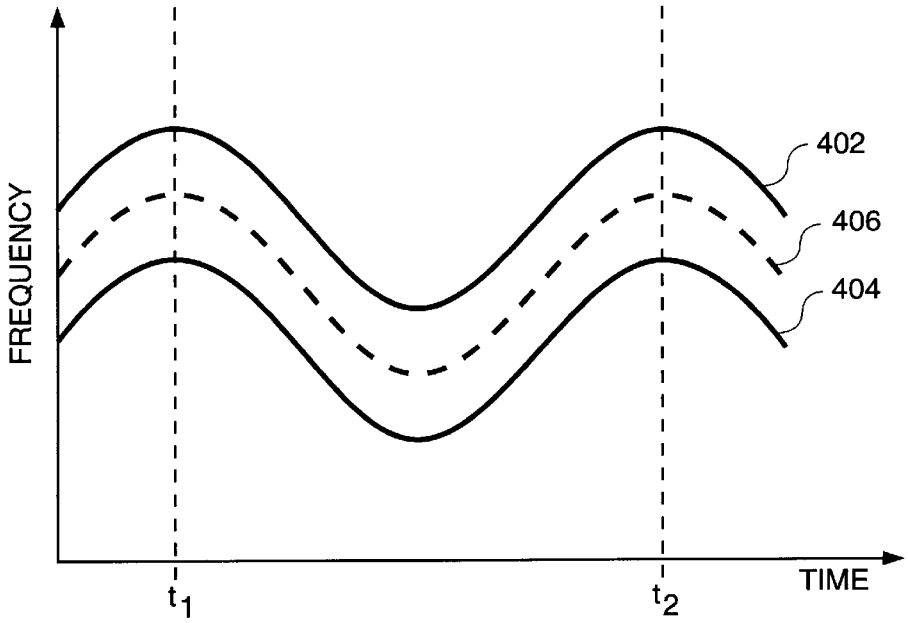
FIG. 4 is an illustration of an example of an idealized signal produced by the apparatus of FIG. 1 when determining pump displacement.

As shown in Table 1, when determining pump displacement the controller 318 preferably applies a low pass filter 324*a* to the capacitive signal and produces a filtered capacitive signal. An example of a possible filtered capacitive signal is illustrated in FIG. 4 as dotted trace 406. A minimum displacement trace 402 and a maximum displacement trace 404 are shown for reference. The interval from time $t_1$ to time $t_2$ represents one revolution of the pump 102.

In one embodiment, the filtered capacitive signal is compared with the minimum displacement trace 402. In another embodiment, the filtered capacitive signal is compared with the maximum displacement trace 404. In still another embodiment, the average of the filtered signal is compared with the average of either the minimum or maximum displacement trace.

Preferably, the comparison is accomplished via a lookup table where the input is a function of the filtered capacitive signal and the output is pump displacement.

Figure 5:
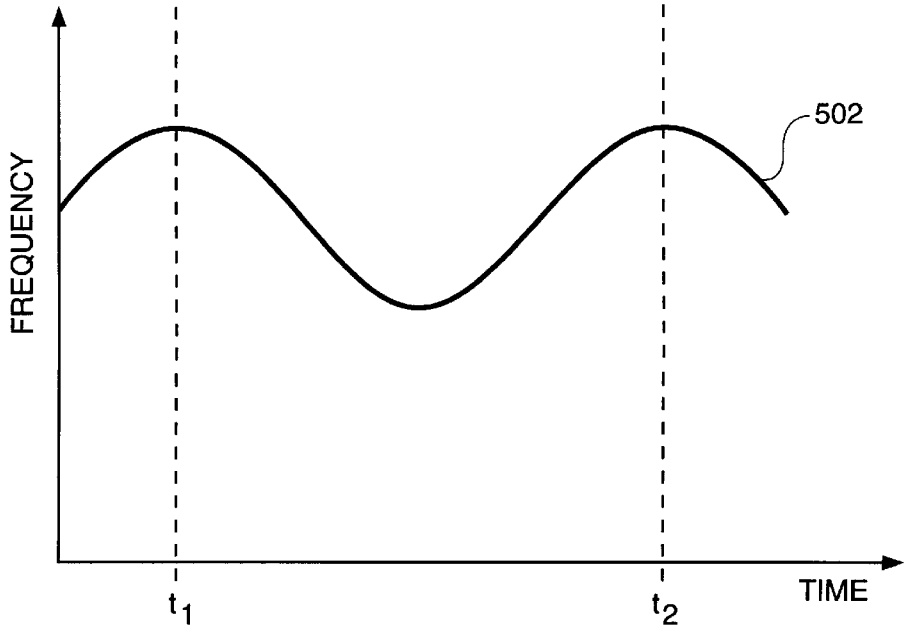
FIG. 5 is an illustration of an example of an idealized signal produced by the apparatus of FIG. 1 when determining pump speed.

When determining pump speed, the controller 318 preferably utilizes a low pass filter 324*a*. An example of a possible filtered capacitive signal is illustrated in FIG. 5 as trace 502. In the preferred embodiment, the peak frequency value of the trace 502 is input into a lookup table and the output is the corresponding pump speed.

Figure 6:
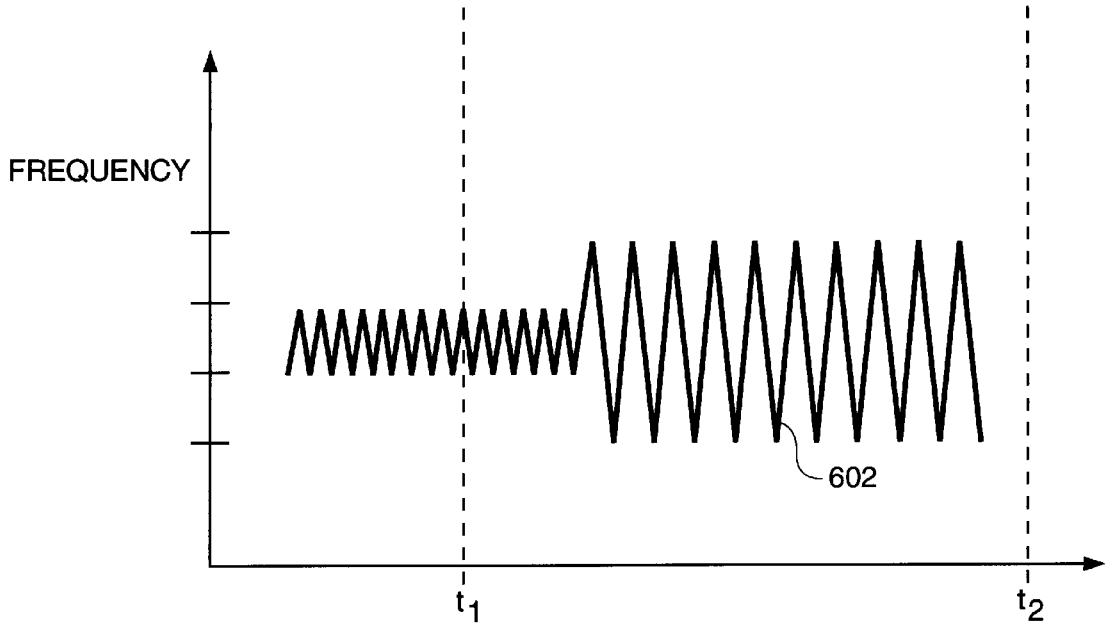
FIG. 6 is an illustration of an example of an idealized signal produced by the apparatus of FIG. 1 when determining pump output pressure.

When determining pump pressure, the controller 318 preferably utilizes a band pass filter 324*b*. An example of a possible filtered capacitive signal is illustrated in FIG. 6 as trace 602. The magnitude of the signals in trace 602 are indicative of the magnitude of the pump pressure. In the preferred embodiment, the root mean square of the filtered capacitive signal is input into a lookup table and the output is the corresponding pump output pressure.

Figure 7:
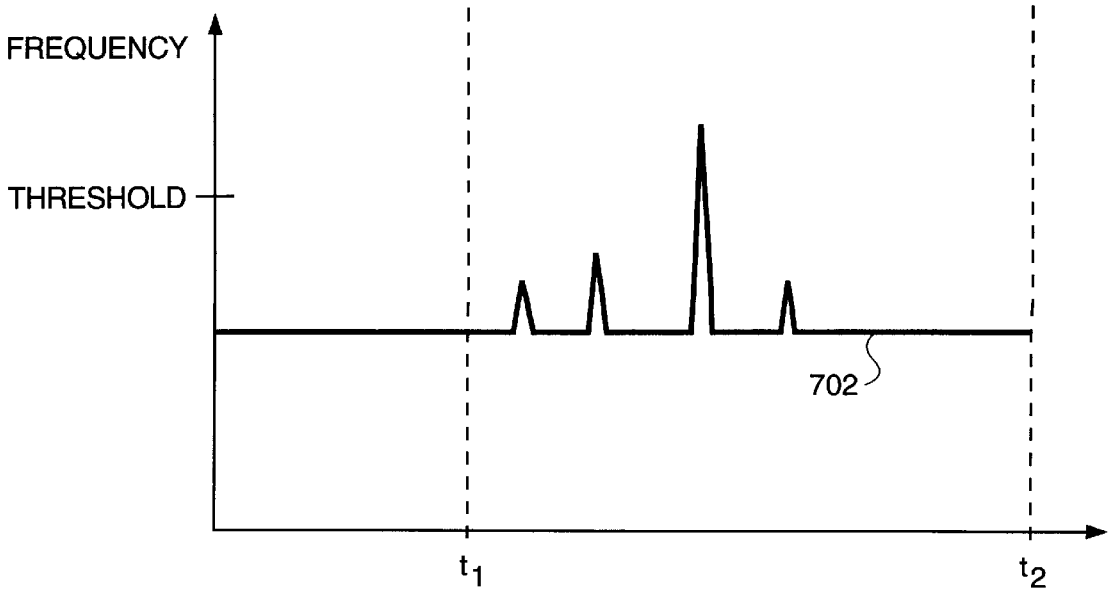
FIG. 7 is an illustration of an example of an idealized signal produced by the apparatus of FIG. 1 when detecting a fault condition of the hydraulic pump.

In a fourth embodiment, the apparatus 100 is adapted for sensing a fault condition of the hydraulic pump 102. The controller 318 applies a high pass filter 324*c* to the capacitive signal and responsively produces a filtered capacitive signal. An example of a possible filtered capacitive signal is illustrated as trace 702 in FIG. 7. In the preferred embodiment, the filtered capacitive signal is compared with a predetermined threshold. A fault condition is said to have occurred if the filtered capacitive signal exceeds the predetermined threshold a predetermined number of times within a predetermined time period. An example of a fault condition is metal to metal contact taking place within the pump 102 due to failure of the hydraulic fluid.

In a fifth embodiment, the controller determines a parameter of the hydraulic pump 102 by applying separate filters

324 to the capacitance signal and adding the results to obtain the filtered capacitance signal. The determination of pump speed, displacement, and pressure is illustrated in Table 2. The output of the band pass filter 324*b* applied to the capacitance signal is equal to the RMS value of the capacitance signal.

TABLE 2

Determined Parameter and Filter Types.

| Determined Parameter | Filter Types |
|---|---|
| pump speed (engine speed) | output of LPF applied to capacitance signal (or, engine speed may be determined directly) |
| pump displacement | output of LPF applied to capacitance signal PLUS output of BPF applied to capacitance signal |
| pump output pressure | output of LPF applied to capacitance signal PLUS output of BPF applied to capacitance signal PLUS output of BPF applied to capacitance signal |

More specifically, the fifth embodiment described above functions as follows.

The pump speed may be directly correlated to the speed of an engine which drives the pump 102. The RMS value of the band pass filter output is added to the value of the pump speed to determine pump displacement. The RMS value of the band pass filter output is added to the value of the pump displacement to determine pump pressure. Alternatively, the RMS value of the band pass filter may be added twice to the value of the pump speed to determine pump pressure directly. Mathematically, the above discussed embodiment may be described as follows.

$$\text{Pump Speed}+\text{BPF}_{RMS}=\text{Displacement} \quad \text{(Eq. 1)}$$

$$\text{Displacement}+\text{BPF}_{RMS}=\text{Pressure} \quad \text{(Eq. 2)}$$

$$\text{Pump Speed}+\text{BPF}_{RMS}+\text{BPF}_{RMS}=\text{Pressure} \quad \text{(Eq. 3)}$$

In yet another alternative embodiment, the hydraulic pump 102 operates by way of one or more pistons located within cylinders (not shown) to provide the pressure needed to pump the hydraulic fluid. For example, a common hydraulic pump used for pumping hydraulic fluid has nine pistons. During operation, the pump internal variable capacitance 314 may be attributed to a sequence of one or more individual pistons as the pistons move and the pump 102 operates. Consequently, the filtered capacitive signal from the band pass filter 324*b* may be analyzed to determine individual piston signatures. This analysis may be compared among each of the pistons in the pump 102, may be compared to known experimental piston signatures, may be trended over time, or any combination of the above methods for analysis.

Figure 8:
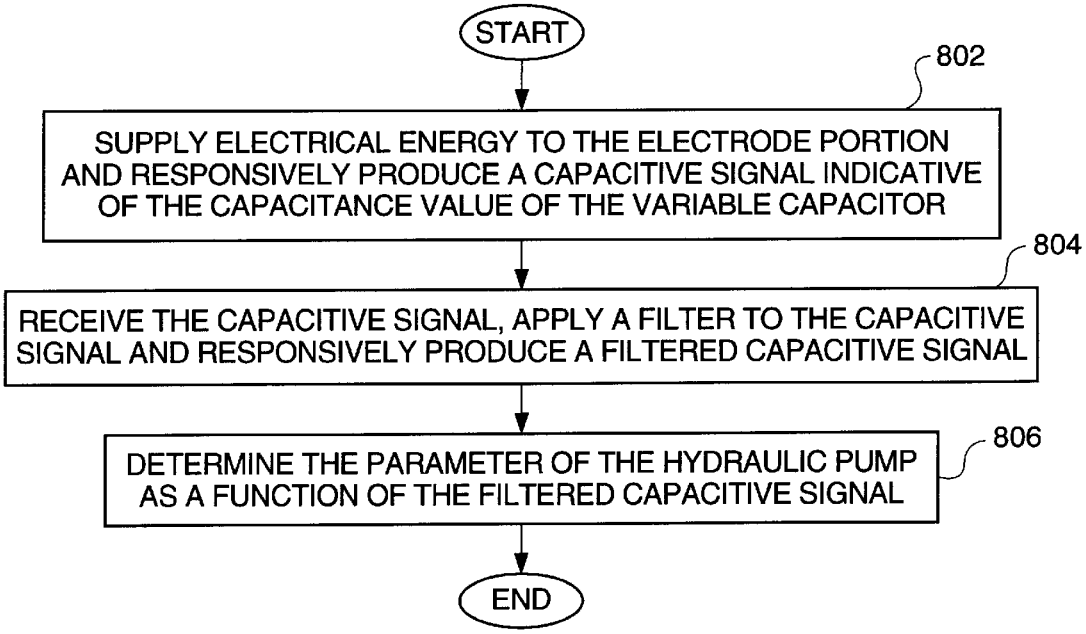
FIG. 8 is a flow diagram of a method for determining a parameter of a hydraulic pump, according to a first embodiment of the present invention.

With reference to FIG. 8, operation of the first embodiment of the present invention will now be discussed.

In a first control block 802, electrical energy is supplied to the electrode portion 108, by way of electrical connections 114,116, and a capacitive signal indicative of the capacitance value of the variable capacitor 314, i.e., the internal variable capacitance of the pump 102, is responsively produced. In a second control block 804, the capacitive signal is received, a filter 324 is applied to the capacitive signal and a filtered capacitive signal is responsively produced. In a third control block 806 the parameter of the hydraulic pump 102 is determined as a function of the filtered capacitive signal.

Figure 9:
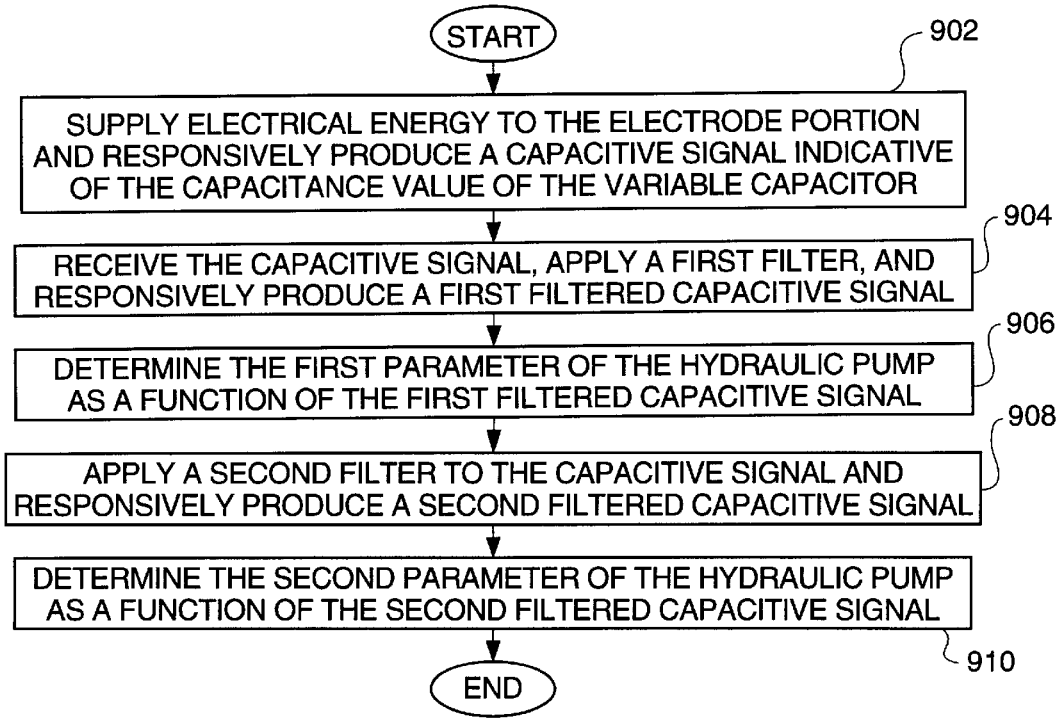
FIG. 9 is a flow diagram of a method for determining first and second parameters of a hydraulic pump, according to a second embodiment of the present invention.

With reference to FIG. 9, operation of the second embodiment of the present invention will now be discussed.

In a fourth control block 902, electrical energy is supplied to the fixed and variable capacitors 302,314 by way of electrical connections 114,116. A capacitive signal indicative of the capacitance value of the variable capacitor 314 is responsively produced. In a fifth control block 904, a first filter 324 is applied to the capacitive signal and a first filtered capacitive signal is responsively produced. In a sixth control block 906, the first parameter of the hydraulic pump 102 is determined as a function of said first filtered capacitive signal. In a seventh control block 908, a second filter 324 is applied to the capacitive signal and a second filtered capacitive signal is responsively produced. In an eighth control block 910, the second parameter of the hydraulic pump 102 is determined as a function of said second filtered capacitive signal.

Figure 10:
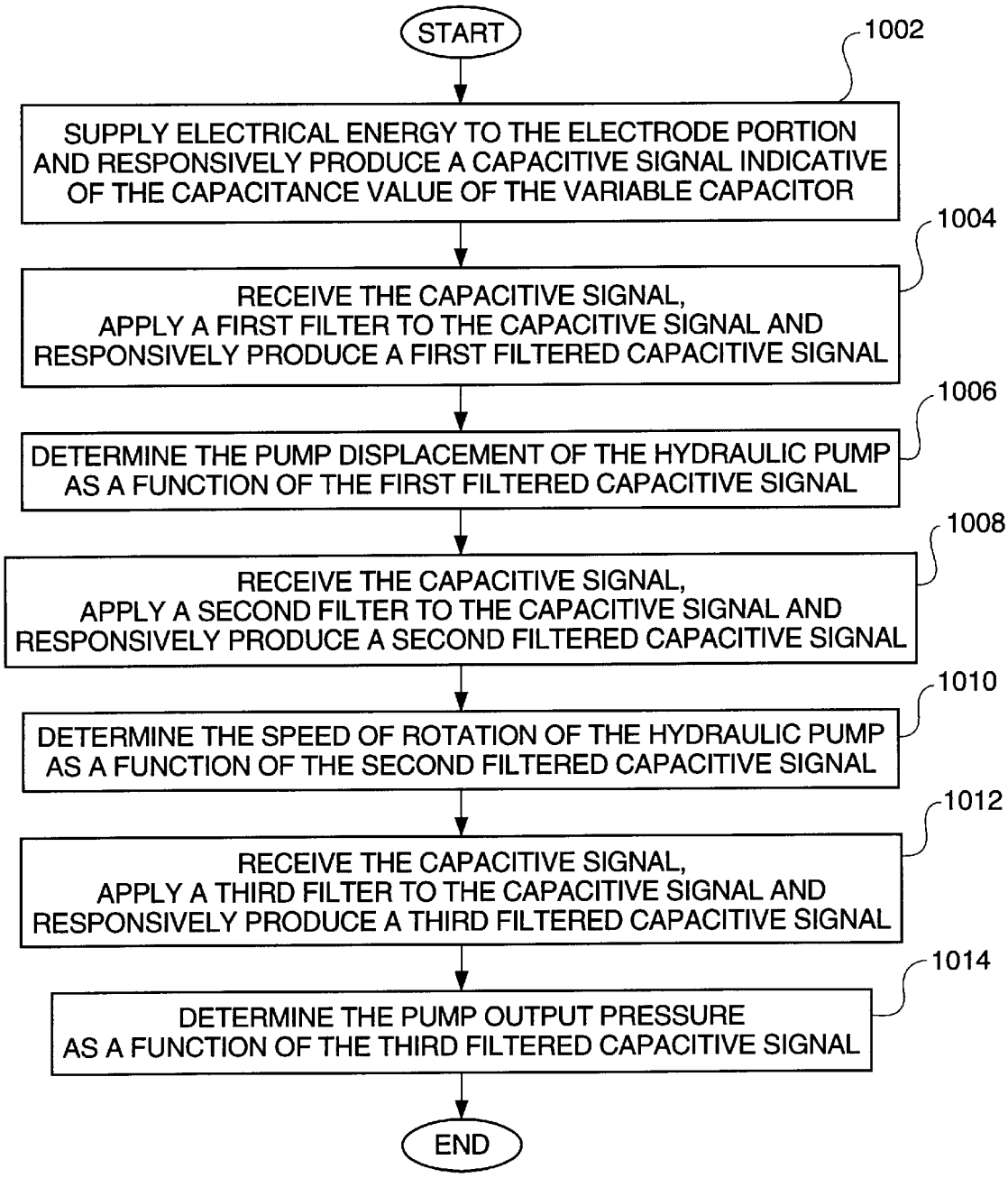
FIG. 10 is a flow diagram of a method for determining pump displacement, pump speed, and pump output pressure, according to a third embodiment of the present invention.

With reference to FIG. 10, operation of the third embodiment of the present invention will now be discussed.

In a ninth control block 1002, electrical energy is supplied to the electrode portion 108 and the pump 102 by way of electrical connections 114,116. A capacitive signal indicative of the capacitance value of the variable capacitor 314 is responsively produced. In a tenth control block 1004, a first filter 324 is applied to the capacitive signal and a first filtered capacitive signal is responsively produced. In an eleventh control block 1006, the pump displacement of the hydraulic pump 102 is determined as a function of the first filtered capacitive signal.

In a twelfth control block 1008, a second filter 324 is applied to the capacitive signal and a second filtered capacitive signal is responsively produced. In a thirteenth control block 1010, the speed of rotation of the hydraulic pump 102 is determined as a function of the second filtered capacitive signal.

In a fourteenth control block 1012, a third filter 324 is applied to the capacitive signal and a third filtered capacitive signal is responsively produced. In a fifteenth control block 1014, the pump output pressure is determined as a function of the third filtered capacitive signal.

Figure 11:
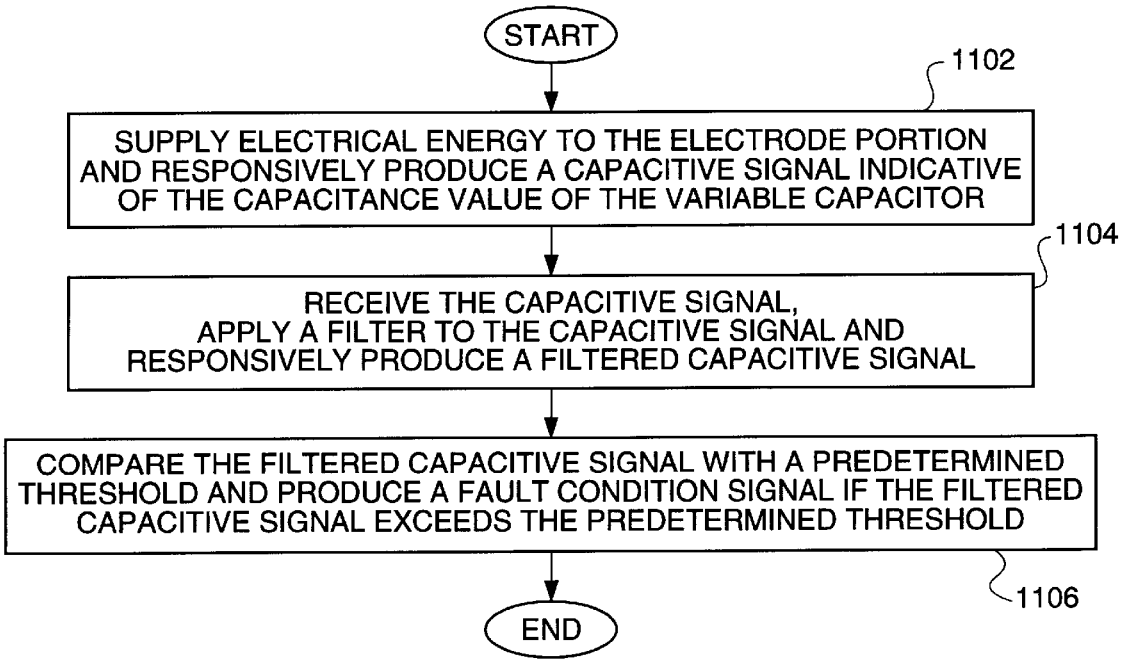
FIG. 11 is a flow diagram of a method for detecting a fault condition of a hydraulic pump.

With reference to FIG. 11, operation of the present invention according to a fourth embodiment will now be discussed. In a sixteenth control block 1102, electrical energy is supplied to the electrode portion 108, by way of electrical connections 114,116, and the internal pump capacitance and a capacitive signal indicative of the capacitance value of the variable pump capacitance is produced. In a seventeenth control block 1104, a filter 324 is applied to the capacitive signal and a filtered capacitive signal is responsively produced. In an eighteenth control block 1106, the filtered capacitive signal is compared with a predetermined threshold and a fault condition signal is produced if the filtered capacitive signal exceeds the predetermined threshold.

Industrial Applicability

With reference to the drawings and operation, the present invention provides an apparatus 100 and method for determining at least one parameter of a hydraulic pump 102. An electrode portion 108 is provided such that a fixed capacitor 302 is formed between the input shaft 106 of the hydraulic pump 102 and the electrode portion 108. The pump 102 forms a variable capacitance capacitor 314 connected in series with the fixed capacitor 302.

A power supply circuit 306 and an oscillator circuit 312 produce a capacitive signal indicative of the capacitance of the variable capacitor 314, i.e., the internal variable capacitance of the pump 102.

A controller 318 applies a filter 324 to the capacitive signal to produce a filtered signal. Typically, the controller 318 will apply a filter 324 for each parameter to be sensed and will produce respective filtered capacitive signals.

The filtered capacitive signals will be analyzed as described above to determine a value for pump displacement, pump speed, pump output pressure and/or a fault condition of the pump 102.

Other aspects, objects, and features of the present invention can be obtained from a study of the drawings, the disclosure, and the appended claims.

What is claimed is:

1. An apparatus for sensing a parameter of a hydraulic pump, the hydraulic pump includes a housing and an input shaft, the shaft being rotationally driven relative to the housing and being electrically coupled to the housing, the hydraulic pump forming a variable capacitor, comprising:

an electrode portion positioned adjacent to the input shaft and being electrically isolated from the housing and input shaft, the electrode portion and the input shaft forming a fixed capacitor, the fixed capacitor being serially connected to the variable capacitor, the capacitive value being indicative of the parameter;

power supplying means for supplying electrical energy to the electrode portion;

oscillator means for producing a capacitive signal indicative of the capacitance value of the variable capacitor; and controlling means for receiving the capacitive signal, for applying a filter to the capacitive signal and responsively producing a filtered capacitive signal, and for determining the parameter of the hydraulic pump as a function of the filtered capacitive signal.

2. An apparatus, as set forth in claim 1, wherein the parameter is pump displacement.

3. An apparatus, as set forth in claim 2, wherein the filter is a low pass filter.

4. An apparatus, as set forth in claim 1, wherein the parameter is rotational speed of the input shaft.

5. An apparatus, as set forth in claim 4, wherein the filter is a low pass filter.

6. An apparatus, as set forth in claim 1, wherein the parameter is pump output pressure.

7. An apparatus, as set forth in claim 6, wherein the filter is a band pass filter.

8. An apparatus, as set forth in claim 1, wherein the parameter is pump displacement and the filter is a low pass filter, and wherein the controlling means includes means for applying a band pass filter to the capacitance signal and wherein the filtered capacitance signal is determined by adding the output of the low pass filter to the output of the band pass filter.

9. An apparatus, as set forth in claim 1, wherein the parameter is pump pressure and the filter is a low pass filter, and wherein the controlling means includes means for applying a band pass filter to the capacitance signal and wherein the filtered capacitance signal is determined by adding the output of the low pass filter to twice the output of the band pass filter.

10. An apparatus for sensing first and second parameters of a hydraulic pump, the hydraulic pump including a housing and an input shaft, the shaft being rotationally driven relative to the housing and being electrically coupled to the housing, the hydraulic pump forming a variable capacitor, comprising:

an electrode portion positioned adjacent to the input shaft and being electrically isolated from the housing and input shaft, the electrode portion and the input shaft forming a fixed capacitor coupled to the variable capacitor;

power supplying means for supplying electrical energy to the electrode portion;

oscillator means for producing a capacitive signal indicative of the capacitance value of the variable capacitor; and controlling means for receiving the capacitive signal; for applying a first filter to the capacitive signal and responsively producing a first filtered capacitive signal, and determining the first parameter of the hydraulic pump as a function of the first filtered capacitive signal; and for applying a second filter to the capacitive signal and responsively producing a second filtered capacitive signal, and determining the second parameter of the hydraulic pump as a function of the second filtered capacitive signal.

11. An apparatus for sensing pump displacement, pump revolutions per minute, and output pressure of a hydraulic pump, the hydraulic pump including a housing and an input shaft, the shaft being rotationally driven relative to the housing and being electrically coupled to the housing, the hydraulic pump forming a variable capacitor, comprising:

an electrode portion positioned adjacent to the input shaft and being electrically isolated from the housing and input shaft, the electrode portion and the input shaft forming a fixed capacitor, the variable capacitor being coupled to the fixed capacitor;

power supplying means for supplying electrical energy to the electrode portion;

oscillator means for producing a capacitive signal indicative of the capacitance value of the variable capacitor; and controlling means for receiving the capacitive signal; for applying a first filter to the capacitive signal and responsively producing a first filtered capacitive signal, and determining the pump displacement of the hydraulic pump as a function of the first filtered capacitive signal; and for applying a second filter to the capacitive signal and responsively producing a second filtered capacitive signal, and determining the speed of rotation of the hydraulic pump as a function of the second filtered capacitive signal; and for applying a third filter to the capacitive signal and responsively producing a third filtered capacitive signal, and determining the pump output pressure as a function of the third filtered capacitive signal.

12. An apparatus, as set forth in claim 11, wherein the first filter is a low pass filter.

13. An apparatus, as set forth in claim 11, wherein the second filter is a low pass filter.

14. An apparatus, as set forth in claim 11, wherein the third filter is a band pass filter.

15. An apparatus for sensing a fault condition of a hydraulic pump, the hydraulic pump including a housing and an input shaft, the shaft being rotationally driven relative to the housing and being electrically coupled to the housing, the hydraulic pump forming a variable capacitor, comprising:

an electrode portion positioned adjacent to the input shaft and being electrically isolated from the housing and input shaft, the electrode portion and the input shaft forming a fixed capacitor, the fixed capacitor being coupled to the variable capacitor;

power supplying means for supplying electrical energy to the electrode portion;

oscillator means for producing a capacitive signal indicative of the capacitance value of the variable capacitor; and controlling means for receiving the capacitive signal, for applying a filter to the capacitive signal and responsively producing a filtered capacitive signal, and for comparing the filtered capacitive signal with a predetermined threshold and producing a fault condition signal if the filtered capacitive signal exceeds the predetermined threshold.

16. An apparatus, as set forth in claim 15, wherein the filter is a high pass filter.

17. A method for sensing a parameter of a hydraulic pump, the hydraulic pump including a housing, an input shaft, and an electrode portion, the input shaft being rotationally driven relative to the housing and being electrically coupled to the housing, the electrode portion positioned adjacent to the input shaft and being electrically isolated from the housing and input shaft, the hydraulic pump forming a variable capacitor and the electrode portion and the input shaft forming a fixed capacitor, including the steps of:

supplying electrical energy to the electrode portion and responsively producing a capacitive signal indicative of the capacitance value of the variable capacitor;

receiving the capacitive signal, applying a filter to the capacitive signal and responsively producing a filtered capacitive signal; and determining the parameter of the hydraulic pump as a function of the filtered capacitive signal.

18. A method, as set forth in claim 17, wherein the parameter is pump displacement.

19. A method, as set forth in claim 18, wherein the filter is a low pass filter.

20. A method, as set forth in claim 17, wherein the parameter is rotational speed of the input shaft.

21. A method, as set forth in claim 20, wherein the filter is a low pass filter.

22. A method, as set forth in claim 17, wherein the parameter is pump output pressure.

23. A method, as set forth in claim 22, wherein the filter is a band pass filter.

24. A method for sensing first and second parameters of a hydraulic pump, the hydraulic pump including a housing, an input shaft, and an electrode portion, the shaft being rotationally driven relative to the housing and being electrically coupled to the housing, the electrode portion positioned adjacent to the input shaft and being electrically isolated from the housing and input shaft, the hydraulic pump forming a variable capacitor and the electrode portion and the input shaft forming a fixed capacitor, including the steps of:

supplying electrical energy to the electrode portion and responsively producing a capacitive signal indicative of the capacitance value of the variable capacitor;

receiving the capacitive signal, applying a first filter to the capacitive signal and responsively producing a first filtered capacitive signal;

determining the first parameter of the hydraulic pump as a function of the first filtered capacitive signal;

applying a second filter to the capacitive signal and responsively producing a second filtered capacitive signal; and determining the second parameter of the hydraulic pump as a function of the second filtered capacitive signal.

25. A method for sensing pump displacement, pump revolutions per minute, and output pressure of a hydraulic pump, the hydraulic pump including a housing, an input shaft, and an electrode portion, the shaft being rotationally driven relative to the housing and being electrically coupled to the housing, the electrode portion positioned adjacent to the input shaft and being electrically isolated from the housing and input shaft, the hydraulic pump forming a variable capacitor and the electrode portion and the input shaft forming a fixed capacitor, including the steps of:

supplying electrical energy to the electrode portion and responsively producing a capacitive signal indicative of the capacitance value of the variable capacitor;

receiving the capacitive signal, applying a first filter to the capacitive signal and responsively producing a first filtered capacitive signal;

determining the pump displacement of the hydraulic pump as a function of the first filtered capacitive signal;

receiving the capacitive signal, applying a second filter to the capacitive signal and responsively producing a second filtered capacitive signal;

determining the speed of rotation of the hydraulic pump as a function of the second filtered capacitive signal;

receiving the capacitive signal, applying a third filter to the capacitive signal and responsively producing a third filtered capacitive signal; and determining the pump output pressure as a function of the third filtered capacitive signal.

26. A method, as set forth in claim 25, wherein the first filter is a low pass filter.

27. A method, as set forth in claim 25, wherein the second filter is a low pass filter.

28. A method, as set forth in claim 25, wherein the third filter is a band pass filter.

29. A method for sensing a fault condition of a hydraulic pump, the hydraulic pump including a housing, an input shaft, and an electrode portion, the shaft being rotationally driven relative to the housing and being electrically coupled to the housing, the electrode portion positioned adjacent to the input shaft and being electrically isolated from the housing and input shaft, the hydraulic pump forming a variable capacitor and the electrode portion and the input shaft forming a fixed capacitor, including the steps of:

supplying electrical energy to the electrode portion and producing a capacitive signal indicative of the capacitance value of the variable capacitor;

receiving the capacitive signal, applying a filter to the capacitive signal and responsively producing a filtered capacitive signal; and comparing the filtered capacitive signal with a predetermined threshold and producing a fault condition signal if the filtered capacitive signal exceeds the predetermined threshold.

30. A method, as set forth in claim 29, wherein the filter is a high pass filter.

31. An apparatus for sensing a parameter of a hydraulic pump, the hydraulic pump includes a housing and an input shaft, the shaft being rotationally driven relative to the housing and being electrically coupled to the housing, the hydraulic pump forming a variable capacitor, comprising:

an electrode portion positioned adjacent to the input shaft and being electrically isolated from the housing and input shaft, the electrode portion and the input shaft forming a fixed capacitor, the fixed capacitor being serially connected to the variable capacitor, the capacitive value being indicative of the parameter;

power supplying means for supplying electrical energy to the electrode portion;

a timing circuit for producing a capacitive signal indicative of the capacitance value of the variable capacitor; and controlling means for receiving the capacitive signal, for applying a filter to the capacitive signal and responsively producing a filtered capacitive signal, and for determining the parameter of the hydraulic pump as a function of the filtered capacitive signal.

* * * * *